United States Patent [19]

Fischer

[11] Patent Number: 4,715,519

[45] Date of Patent: Dec. 29, 1987

[54] ROLLED DISPENSER FOR CUTTING A CONTINUOUS ROLLED SHEET AND A BLANK THEREFOR

[75] Inventor: David Fischer, Downsview, Canada

[73] Assignee: Domtar Inc., W. Montreal, Canada

[21] Appl. No.: 856,833

[22] Filed: Apr. 28, 1986

[51] Int. Cl.[4] ..... B26F 3/02

[52] U.S. Cl. ..... 225/48; 225/80; 225/90

[58] Field of Search ..... 275/48, 49, 50, 53, 275/90, 80

[56] References Cited

U.S. PATENT DOCUMENTS

| | | | |
|---|---|---|---|
| 1,938,269 | 12/1933 | Wilson | 225/48 |
| 2,936,937 | 5/1960 | Guyer | 225/48 |
| 3,144,970 | 8/1964 | Beschmann | 225/49 |
| 3,565,307 | 2/1971 | Wiley | 225/90 |
| 3,698,548 | 10/1972 | Stenzel et al. | 225/48 |
| 4,095,730 | 6/1978 | Clatterbuck | 225/90 |
| 4,238,065 | 12/1980 | Ragsdale | 225/48 |
| 4,582,234 | 4/1986 | Marcoux | 225/48 |

*Primary Examiner*—Paul A. Bell
*Assistant Examiner*—Hien H. Phan

[57] ABSTRACT

The roll dispenser has as a box for receiving a roll of continuous sheet material, having a bottom, a pair of sides oriented longitudinal with respect to the roll, a pair of sides axial with respect to the roll. One of the longitudinal sides is adapted for receiving a cutting element, at least one tongue element is mounted on at least one of the sides of the box in space relation with the longitudinal side receiving the cutting element. The tongue prevents the recoil of the free end of sheet material onto the roll. In one embodiment, the roll dispenser further comprises a longitudinal side defining the top of the box, at least a portion of its longitudinal sides hingedly mounted to define a gap near the cutting and tongue elements. Also disclosed is a blank for constructing the box.

9 Claims, 5 Drawing Figures

ROLLED DISPENSER FOR CUTTING A CONTINUOUS ROLLED SHEET AND A BLANK THEREFOR

FIELD OF THE INVENTION

This invention relates to a roll dispenser for cutting a continuous rolled sheet material and blanks therefor. More particularly, this invention relates to a dispensing carton for rolled sheet material to provide improved sheet material feeding and cutting.

BACKGROUND OF THE PRESENT INVENTION

Rolled sheet dispensing cartons are generally provided with an outer shell to hold the rolled sheet, a removable cover to gain access to the sheet and a serrated blade for tearing the sheet at a desired length.

Canadian Pat. Nos. 732,025 as invented by Buttery et al and 738,265 as invented by Fin et al, disclose dispensing cartons containing a roll of sheet material which rolls against the outer side walls or panels thereof. This produces a relatively high contact surface area causing friction between the roll and the outer side walls. This occurs particularly in the case where relatively large rolls of sheet material are dispensed. A removable cover portion permits full user contact with the roll and increases the risk of damage to the roll by inadvertent mishandling.

Also disclosed, is a cutter edge or tear blade fastened on the exterior of the shell and fully exposed to the user, thus posing as a safety hazard. Moreover, the sheet material tends to slip over the exposed cutter edge during the tearing action, often resulting in an uneven or rough separation. A further problem arises when the free end of sheet material slips back onto the roll, due to the electrostatic potential or the resiliency of the sheet material.

OBJECTS OF THE PRESENT INVENTION

The object of the present invention is to provide a dispensing carton preventing recoil of the sheet material.

In a particular embodiment, it is a further object of the present invention is to provide a dispensing carton for sheet material having reduced friction during dispensing.

In another particular embodiment, the present invention provide a dispensing carton yielding an even and clean separation of sheet material.

In another embodiment, the invention provides a dispensing carton with a serrated cutting edge, recessed to reduce the danger of personal injury.

BRIEF DESCRIPTION OF THE PRESENT INVENTION

Broadly stated, the invention comprises:

a box for receiging a roll of continuous sheet material having a bottom, a pair sides longitudinally oriented respect to said roll a pair of sides axially oriented with respect to said roll, one of said longitudinal sides being adapted for receiving a cutting element, at least one tongue element mounted on at least one of the sides of said box, in space relation with said longitudinal side for receiving said cutting element for preventing the recoil of the free end of sheet material onto said roll, whereby upon cutting said sheet material, the end portion thereof remains on said at least one tongue element and can be rapidly withdrawn to be further cut by said cutting element.

The term "recoil" generally means the act of rebounding or springing back. In this case, the term "recoil" is used to describe the action of the free end of sheet material as it makes contact with the roll, usually due to an electrostatic potential or the resiliency of the sheet material.

The term "sheet material" is meant to include material in sheet form such as plastic sheet products (i.e. stretch plastics and perforated preformed), paper products (e.g. shelf paper), aluminum foils and other materials, suitable for a dispensing carton, which can be cut.

The invention is also direct to at least one tongue element centrally positioned with respect to the length of said gap and further includes mounted thereon, at least one gripping element upwardly projecting from said tongue element so as to lift a portion of said sheet material under said hinged portion thereby providing easier access for gripping said portion of said sheet material.

BRIEF DESCRIPTION OF THE DRAWINGS

Further features, objects and advantages of the present invention will be evident from the following detailed description of a preferred embodiment of the present invention taken in conjunction with the accompanying drawings in which.

Figure 2:
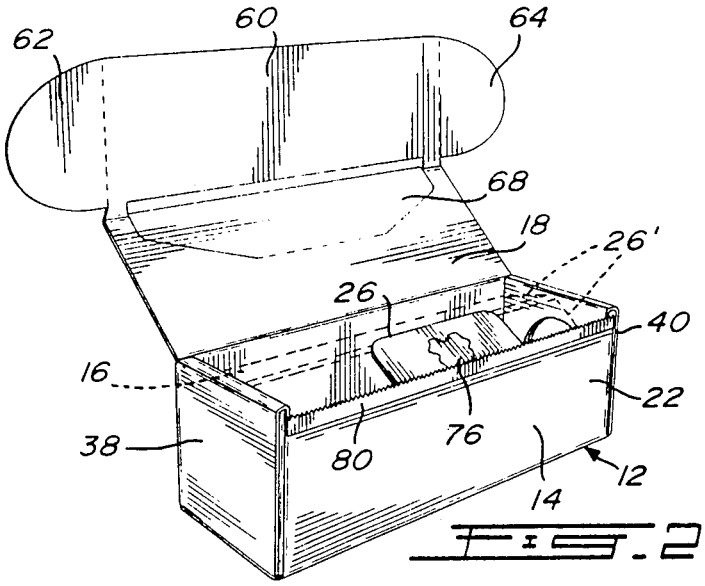
FIG. 2 is an isometric view of the partly assembled blank of FIG. 1 forming a roll dispenser for cuttings continuous rolled sheet material.

Briefly referring to FIG. 2, the dispenser 10 has a box 11 for receiving a roll of continuous sheet material. Box 11 has a bottom wall panel 12, front and rear wall panels 14 and 16 respectively defining the sides longitudinally oriented with respect to the roll to be received. Rear wall end flaps 38 and 40 (to be described) form the sides of the box, axially oriented with respect to the roll to be received.

Front wall panel 14 is further adapted to receive cutting element 80 as will be further described.

Tongue element 26 is mounted on front wall panel 14 for preventing the recoil of the free end of sheet material onto the roll. If desired, a plurality of tongue elements (shown at 26') may be mounted on the panels of box 11 preventing recoil.

Figure 4:
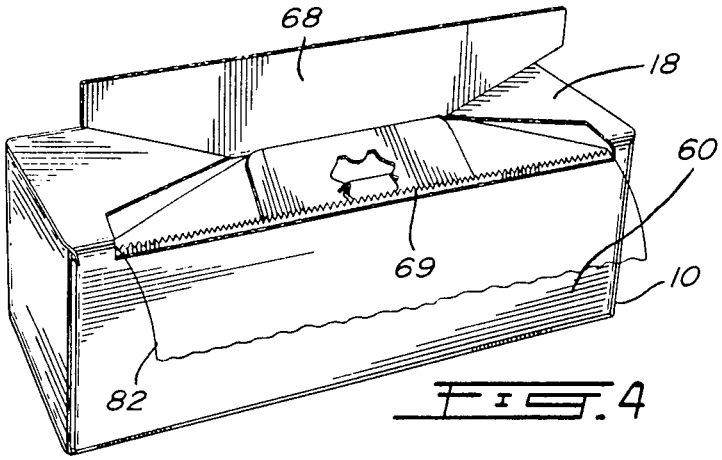
FIG. 4 is an isometric view of the dispensing carton of FIG. 3 with the lift flap opened.

In a particular embodiment, box 11 has a top wall panel 18 foldably connected to rear wall panel 16 and may be coupled to the box by means of overlap wall panel 60 and overlap end flaps 62 and 64, as will be described. A portion 68 of top wall panel 18 defining a lift flap is hingably mounted thereto and has a length substantially corresponding to at least the width of sheet material to be dispensed. Lift flap 68 is seen in its opened position in FIG. 4.

Free end of lift flap 68 stops short of overlap wall panel 60 so as to form a gap (shown at 69, FIG. 3) through which the sheet material is dispensed.

Figure 1:
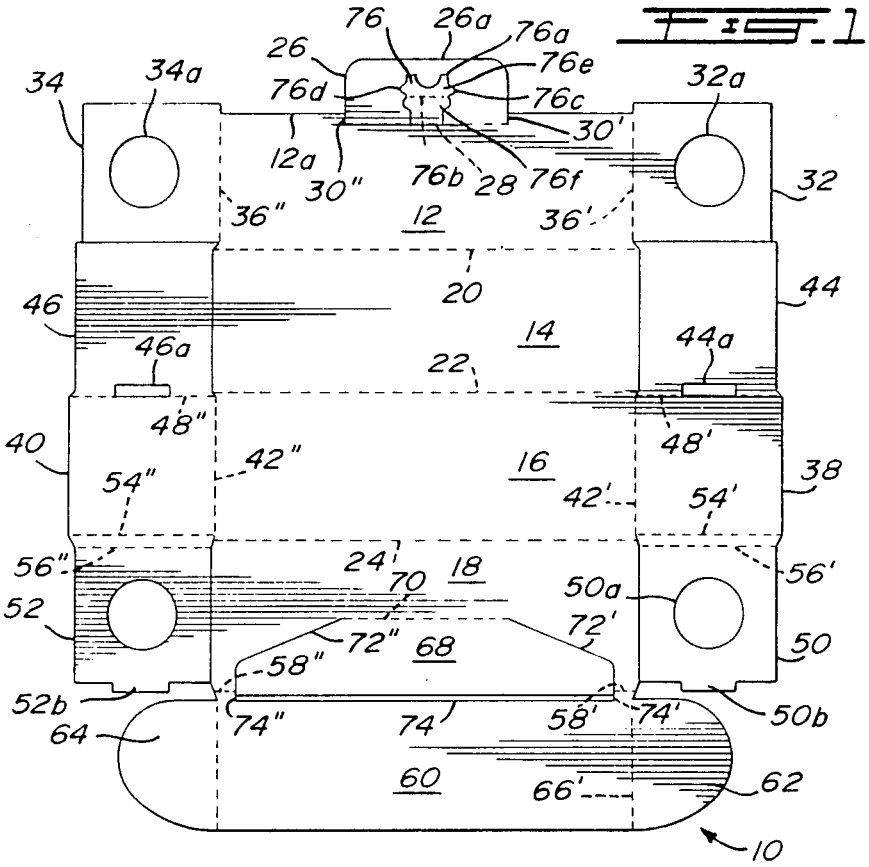
FIG. 1 is a plan view of one form of a blank used to construct a dispensing carton.

Reference will now be made to FIG. 1 for a more detailed description of a blank for constructing the roll dispenser. Blank 10 is cut from a rigid and relatively thick material suitable for forming cartons. Preferably, blank 10 is of a corrugated fibreboard but may be of other types of material including fibre board or plastic, if desired.

Blank 10 comprises front wall panel 12, bottom wall panel 14, rear wall panel 16, and top wall panel 18 foldably connected by a first set of substantially parallel fold lines 20, 22, and 24.

Front wall 12 has a free longitudinal edge 12*a* to receive a cutting element as will be described. Extending from free longitudinal edge 12*a* is projection 26. First fold line 28 is centrally located in front wall panel 12 near free longitudinal edge 12*a* and substantially parallel to the first set of fold lines. A first set of cut lines 30' and 30" extend from first fold line 28 toward free longitudinal edge 12*a*. First set of cut lines 30' and 30" further define with the edges of projection 26, a tongue element to prevent the recoil of the sheet material to be dispensed.

Joined to front wall 12 are a pair of front wall end flaps 32 and 34 by a second set of fold lines 36' and 36" respectively, substantially perpendicular to the first set of fold lines. Each of front wall end flaps 32 and 34 are provided with a circular aperture shown at 32*a* and 34*a* to receive an axial support carrying rolled sheet material, as will be described.

Foldably connected to rear wall panel 16 are rear wall end flaps 38 and 40 at fold lines 42' and 42" respectively, substantially parallel to the second set of fold lines.

Joined to one side of rear wall end flaps 38 and 40 and near bottom wall panel 14 are a pair of first locking flaps 44 and 46 at fold lines 48' and 48" respectively, substantially parallel to the first set of fold lines.

Also connected to rear wall end flaps 38 and 40 opposite to first locking flaps 44 and 46 are second locking flaps 50 and 52 at fold lines 54' and 54" respectively, substantially parallel to the first set of fold lines. If desired, a second pair of fold lines 56' and 56" substantially parallel to lines 54' and 54" may be used to obtain a rectangular fold for the insertion of tuck flaps, to be described.

Second locking flaps 50 and 52 are further provided with circular apertures 50*a* and 52*a* respectively, centrally located therein to coincide with apertures 32*a* and 34*a* to receive an axial support carrying rolled sheet material, as will be described.

If desired, second locking flaps 50 and 52 may be provided with projections 50*b* and 52*b*, remote of said rear wall end flaps respectively. As well, first locking flaps 44 and 46 may be provided with apertures 44*a* and 46*a* for receiving respectively, projections 50*b* and 52*b* thereby improving the rigidity of the erected dispensing carton as is known.

Connected to top wall panel 18 at a third set of fold lines 58' and 58" substantially parallel to the first set of fold lines is overlap wall panel 60. Joined thereto are a pair of tuck flaps 62 and 64 at fold lines 66' and 66" respectively substantially parallel to the second set of fold lines.

Formed in top wall and overlap panels 18 and 60 is a lift flap 68 by second fold line 70 located in top wall panel 18 near the third set of fold lines 58' and 58" and substantially parallel to the first set of fold lines.

Extending from the second fold line 70 toward the third set of fold lines 58' and 58" is a set of tear lines 72' and 72". Also extending toward the third set of fold lines 58' and 58" so as to meet the ends of the set of tear lines 72' and 72" respectively is first cut line 74.

If desired, first cut line 74 may be curved or rectangular in shape as seen in FIG. 1. In this case, a major portion of first cut line 74 is substantially parallel to the third set of fold lines, while end portions 74' and 74" may extend toward the third set of fold lines 58' and 58" respectively, so as to meet the ends of the set of tear lines 72' and 72", respectively. Thus, lift flap 68 provides user access to tongue element 26 and to the free end of the roll of sheet material therein while minimizing user access to the roll itself.

In a further embodiment, a gripping element 76 is provided in tongue element 26 by means of a second cut line 76*a* near the free end 26*a* of tongue element 26 and oriented with respect thereto, and a third fold line 76*b* between between second cut line 76*a* and first fold line 28 and substantially parallel thereto. Joining first and third fold lines 28 and 76*b* and second cut line 76*a* to complete the gripping flap is a third set of cut lines 76*c* and 76*d*.

Third set of cut lines 76*c* and 76*d* thereby define with second cut line 76*a* and third fold line 76*b*, an outer portion 76*e*, and define with first fold line 28 and third fold line 76*b* an inner portion 76*f*. Furthermore, the third set of cut lines are shaped to provide means for securing outer portion in an upward folded position with respect to inner portion 76*f* about third fold line 76*b*.

If desired, cut lines 76*c* and 76*d* may be sinusoidal in shape so as to form a plurality of alternating projections on gripping flap 76 and tongue element 26. As well, the third set of cut lines 76*c* and 76*d* may have axes angular with respect to the first fold line 28 thereby forming a substantially trapezoidal shaped gripping flap to improve the securing of outer portion 76*e* in an upward folded position with respect to inner portion 76*f*.

Cut lines 76*c* and 76*d* may also be zig-zag, wedged or of another shape to provide the necessary projections to secure outer and inner portions 76*e* and 76*f* respectively in their upright folded position.

To construct the dispensing carton, front wall panel 12 and rear wall panel 16 are folded in face-to-face relationship with respect to fold lines 20 and 22 respectively and perpendicular with respect to bottom wall panel 14. First locking flaps 44 and 46 are folded perpendicular to rear wall end flaps 38 and 40 with respect to fold lines 48' and 48" respectively. Next, rear wall end flaps 38 and 40 are folded perpendicular to rear wall panel 16 with respect to fold lines 42' and 42" respectively, thereby bringing first locking flaps 44 and 46 into contact with the inner surface of bottom wall panel 14.

Front wall end flaps 32 and 34 are then folded perpendicular to front wall panel 12 and with respect to fold lines 36' and 36" respectively and are brought into contact with the inner face of rear wall end flaps 38 and 40 respectively. Following this, second locking flaps 50 and 52 are folded with respect to fold lines 54', 54" and 56', 56" and brought into contact with the inner face of front wall end flaps 32 and 34 respectively, thereby making apertures 32*a* and 34*a* coincident with apertures 50*a* and 52*a* respectively to receive an axial support for rolled sheet material.

Figure 5:
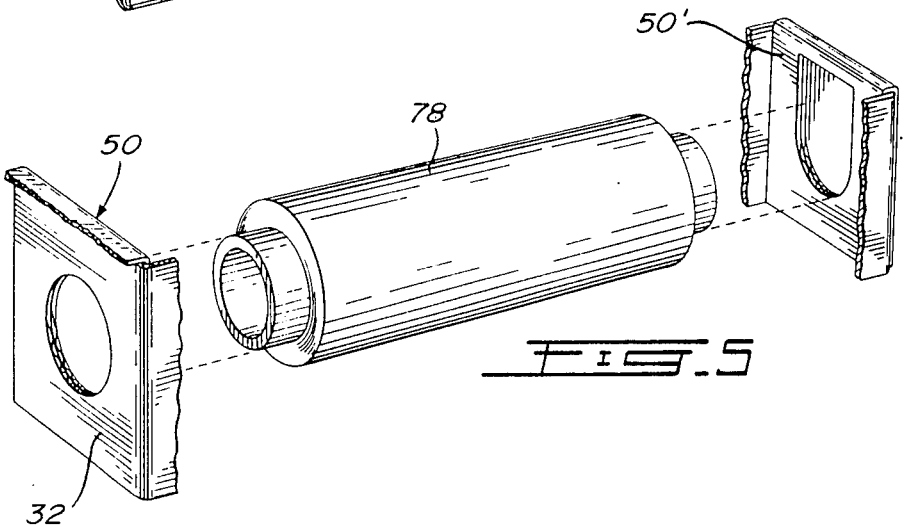
FIG. 5 illustrates two variations of the concave surface element.

At this point, an axial support 78 with sheet material rolled thereon is inserted in the coincident apertures 32*a*, 50*a* and 34*a*, 52*a* (as shown in FIG. 5). Due to the relatively thick material chosen for blank 10, coincident apertures 32*a*, 50*a* and 34*a*, 52*a* provide a sufficient concave contact area for holding and enabling rotation of the axial support therein. If desired, the concave element may also have other configurations including a saddle-shaped element as shown by flap 50' in FIG. 5.

Also, fold lines 54', 54" and 56', 56" provide a rectangular fold and thereby a channel between rear wall end flaps 38, 40 and second locking flaps 50, 52 respectively for receiving front wall end flaps 32 and 34 and tuck flaps 62 and 64 respectively, as will be described.

Tongue element 26 is inwardly folded with respect to first fold line 28 and a cutting element (shown at 80 in FIG. 2) placed on face longitudinal edge 12*a* of front wall panel 12 to be held thereon by top wall 18 and overlap panels as will be described.

If desired, the outer portion 76*e* of gripping element 76 may be secured in an upward folded position with respect to the inner portion 76*f* thereof about third fold line 76*b*. At this point, the free end 82 of the sheet material may be pulled over tongue element 26.

Top wall panel 18 is then folded perpendicular with respect to rear wall panel 16 while overlap panel 60 folded perpendicular to top wall panel 18. Tuck flaps 62 and 64 are then folded perpendicular to overlap panel 16 with respect to fold line 66' and 66" respectively and inserted between rear wall end flap 38, 40 and front wall end flaps 32, 34 respectively, thereby contacting overlap panel 60 with the outside surface of front wall panel 12. If desired, tuck flaps 62 and 64 or overlap panel 60 may be glued or fastened in position to prevent dismantling of the dispensing carton.

To dispense the sheet material, the user lifts lift flap 68 against tear lines 72' and 72", to find the free end 82 positioned between tongue element 26 and top wall panel 18 and the recessed serrated cutter 80.

Figure 3:
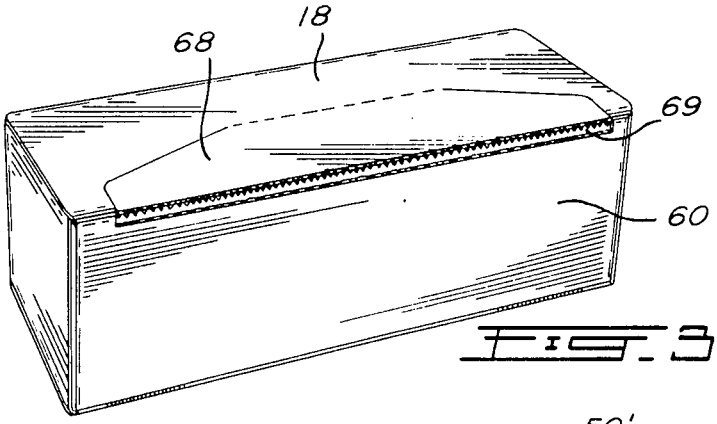
FIG. 3 is an isometric view of the assembled dispensing carton of FIG. 2.

In this manner, overlap panel 60 and back flaps 62 and 64 need not be removed at any time during the use of the dispensing carton. Furthermore, the serrated cutter 80 is recessed by overlap wall panel 60 and top wall panel 18 (as shown in FIG. 3) so as to reduce the danger of user injury due to inadvertent contact therewith.

The rigid lift flap distributes the pressure applied thereon by the user in order to pinch the sheet material against the recessed serrated cutter 80 reducing the slipping of sheet material thereover and thereby yielding an even and clean separation. Moreover, bridging flap 26 prevents the recoil of the free end 82 back onto the roll 84.

As well, the gripping flap 76 facilitates the gripping of the free end 82 by the user who merely pinches the sheet material against the gripping flap 76 with the thumb and forefinger.

Having described the invention, modifications will be evident to those skilled in the art without departing from the spirit of the invention as defined in the appended claims.

I claim:

1. A roll dispenser for cutting a continuous rolled sheet of material comprising: a box having a bottom, a pair of opposite longitudinal sides extending from said bottom, a pair of opposite ends extending from at least one of said longitudinal sides and said bottom, said ends being perpendicularly oriented with respect to said longitudinal sides, and defining said box for receiving a roll of continuous sheet material, a first of said longitudinal sides having a longitudinal free edge away from said bottom being provided with a cutting element, at least one tongue element inwardly and upwardly mounted on said first of said longitudinal sides and near said longitudinal free edge, a second of said longitudinal sides extends away from said bottom into a hingedly connected longitudinal panel defining a top for said box said at least one tongue element having an edge away from said first of said longitudinal sides, said edge providing support in space relation between said cutting element on said first of said longitudinal sides and a roll of continuous sheet material to be received in said box, whereby, upon insertion of said roll of sheet material in said box said edge projects into, biases against and supports said sheet material between said top and said at least one tongue element to prevent the recoil of the free end of sheet material onto said roll, and whereby upon cutting said sheet material by said cutting element, the end portion of the roll of sheet material remains on said edge of said at least one tongue element and can be rapidly withdrawn to be further cut by said cutting element.

2. The roll dispenser as defined in claim 1, wherein said cutting element projects in part beyond said longitudinal free edge of said first of said longitudinal sides, and wherein said top has a free longitudinal edge away from said second of said longitudinal sides, said free longitudinal edge of said top extending over said cutting element so as to form a longitudinal gap whereby said sheet material is to be dispensed from said roll by moving between said top, and upon and supported by said edge of said at least one tongue element, said at least one tongue element inwardly and upwardly mounted near said gap thereby preventing the recoil of said end portion of sheet material onto said roll, a portion of said top adjacent said longitudinal gap being a hinged lift flap having a longitudinal width for easy access to said end portion of said sheet material to be supported on said edge of said at least one tongue element.

3. The roll dispenser as defined in claim 2 wherein said at least one tongue element is centrally positioned with respect to the length of said gap and further includes mounted thereon, at least one gripping element upwardly projecting from said at least one tongue element so as to lift a portion of said sheet material under said left flap thereby providing easier access for gripping said portion of said sheet material.

4. The roll dispenser as defined in claim 2 wherein said left flap is removably mounted to provide improved access to said sheet material on said at least one tongue element.

5. The roll dispenser as defined in claim 2 wherein said first of said longitudinal sides has mounted on said longitudinal free edge under said lift flap, said cutting element, whereby upon pulling said end portion of sheet material to obtain a desired length of the rolled sheet, said lift flap is pressed to pinch the sheet so pulled between said lift flap and the cutting element to make a cleaner and more square separation of said sheet material, and wherein said cutting element is concealed from user to protect user from injuries.

6. The roll dispenser as defined in claim 2 wherein said first of said longitudinal sides comprises two ends having a foldably connected first panel formed at each of said two ends, each of said first panel having a substantially central aperture, said second of said longitudinal sides having opposed ends and extending at each of said opposed ends about a fold line into a foldably connected second panel, each of said second panel having opposite free edges and extending at said opposite free edges into foldably connected first and second locking flap, each of said first locking flap being adjacent said top and having a substantially central aperture and at least one tab extending away from said second panel, each of said second locking flap having at least one slot adjacent said second panel, wherein for each of said ends of said longitudinal sides, one of said first and one of said second panels, and one of said first and one of said second locking flaps are folded to define a strong box end of triple thickness, said first panel having an edge away from said first of said longitudinal sides meet with said fold line, said second locking flap is adjacent said bottom, said second panel is adjacent an outer surface of said first panel, said foldably connected first locking flap overlaps said first panel to be adjacent an inner surface of said first panel so that the apertures of said first panel and said first locking flap are aligned, a fold between the second panel and the first locking flap defining an injure-free strong upper surface of the box end, said at least one tab inserted into said at least one slot thereby anchoring said first locking flap, the aligned apertures defining a holding and positioning means to enable easy rotation of an axial support for said continuous rolled sheet material, the apertures being aligned as not to cause interference by contact of said roll with said at least one tongue element and said opposite longitudinal sides, said bottom and said top of said box.

7. A rigid blank for constructing a roll dispenser comprising: a bottom wall panel, said bottom wall panel extending via a first fold line into a foldably connected front wall panel, said bottom wall panel further extending away from said front wall panel via a second fold line into a foldably connected rear wall panel, said rear wall panel extending away from said bottom wall panel via a third fold line into a foldably connected top wall panel, each of said first, said second and said third fold line being parallel whereby upon folding said front, bottom, rear and top wall panels, a rectangular box is defined, said front wall panel away from said bottom wall panel having at least one linear free longitudinal edge portion to receive a cutting element, and a projecting tongue element extending from said front wall panel away from said bottom wall panel and beyond said at least one linear free longitudinal edge portion, each of said front, bottom, rear and top wall panels having opposite ends, at least a first flap connected at a first of said opposite ends of at least one of said front, bottom, rear or top wall panels, and a second flap connected at a second of said opposite ends of at least one of said front, bottom, rear or top wall panels, whereby when the blank is folded into said box, on folding said first and said second flap, each of said first and said second flap is releasably lockable with at least one of said wall panels for defining box ends, and said tongue element is inwardly and upwardly directed for projecting into, biasing against, and supporting sheet material to be dispensed from the box between said top panel and said projecting tongue element to prevent recoil of said sheet material.

8. A blank as defined in claim 7 wherein said tongue element is oriented centrally in relation to the length of said front wall panel and wherein said tongue element further includes at least one upwardly projecting gripping element so as to lift away from said tongue element a portion of sheet material to enable easier access for gripping said sheet material to be dispensed from the box.

9. A blank as defined in claim 8 wherein said front wall panel is extending at each of its opposite ends into a foldably connected front wall end flap, each of said front wall end flap having a circular centrally located aperture, said rear wall panel extending at each of its opposite ends into a rear wall end flap, each of said rear wall end flap extending, adjacent said bottom wall panel, about a first fold line into a first locking flap, each of said first locking flap having a slot near said first fold line, each of said rear wall end flap extending away from said first locking flap, about double parallel fold lines into a second locking flap, each of said second locking flap extending away from said rear wall end flap, into a tab, each of said second locking flap having a circular substantially centrally located aperture, said top wall panel extending away from said rear wall panel into a foldably connected overlap panel, a portion of said top wall panel adjacent said overlap panel defining a hinged lift flap, and between said lift flap and said overlap panel is defined a longitudinal gap, said overlap panel having opposite ends and extending at each of its opposite ends into a foldably connected tuck flap, whereby upon assembly of the blank into said box, said first locking flap are juxtaposed with said bottom wall panel, said rear wall end flap are perpendicular to said bottom wall panel, said front wall end flap are juxtaposed with said rear wall end flap, said second locking flap is juxtaposed with said front wall end flap with the area between said double fold lines defining a strong upper continuous surface for a triple thickness box end, said tab inserted into said slot of said first locking flap for anchoring said second locking flap, the apertures in said front wall end flap and in said second locking flap being aligned to define a holding and positioning means for a cylindrical carrier for sheet material.

* * * * *